US005334474A

United States Patent [19]

Abbott et al.

[11] Patent Number: 5,334,474

[45] Date of Patent: Aug. 2, 1994

[54] DRY TONER WITH MIXED AZO DYE CHARGE CONTROL AGENT

[75] Inventors: Jerry J. Abbott, Longmont; Brian W. Baird, Louisville; Michael G. Miller, Longmont, all of Colo.

[73] Assignee: Lexmark International, Inc., Greenwich, Conn.

[21] Appl. No.: 75,440

[22] Filed: Jun. 14, 1993

[51] Int. Cl.[5] ..... G03G 9/097

[52] U.S. Cl. ..... 430/110

[58] Field of Search ..... 430/106, 110, 109

[56] References Cited

U.S. PATENT DOCUMENTS 4,401,741 8/1993 Miyakawa et al. ..... 430/110
5,017,450 5/1991 Iwanari et al. ..... 430/106

FOREIGN PATENT DOCUMENTS 62-024268A 2/1987 Japan ..... G03G 9/10
3094270A 9/1989 Japan ..... G03G 9/09

OTHER PUBLICATIONS

1st page, Material Safety Data Sheet for IBM 3812,3816 Printer Toner.
1st page, Material Safety Data Sheet for ZAPON Yellow 156,141.

*Primary Examiner*—John Goodrow
*Attorney, Agent, or Firm*—John A. Brady

[57] ABSTRACT

A dry toner having Zapon Yellow 141 as a charge control agent, dispersed moderately in the toner. Zapon Yellow 141 is about 95% by weight Solvent Yellow 81 and about 5% by weight Solvent Orange 56.

6 Claims, No Drawings

DRY TONER WITH MIXED AZO DYE CHARGE CONTROL AGENT

TECHNICAL FIELD

This invention relates to dry toners for electrophotography comprising resin, coloring matter, and a charge control agent. This invention employs a novel mixture of dyes as the charge control agent.

BACKGROUND OF THE INVENTION

Chromium complex dyes are widely known as a class of materials useful as charge control agents in dry toner corresponding to this invention. U.S. Pat. No. 4,401,741 to Miyakawa is illustrative. Commercial suppliers offer various chromium complex dyes explicitly for use as such charge control agents, but none are known to be so offered which are closely similar to either of the dyes used together in accordance with this invention.

The Material Safety Data Sheet for the IBM 3812 and 3816 toners includes a dye as the apparent charge control agent as follows: Azoid dye, CAS No. 41741-86-0. BASF offers commercially a dye with this CAS No. 41741-86-0. It is called Zapon Yellow 156. (Zapon is a registered trademark.) The Material Safety Data Sheet for Zapon Yellow 156 states that both Solvent Yellow 21 and C.I. 18690 are synonyms to Zapon Yellow 156. The Colour Index gives the following description of C.I. 18690: A chromium complex of

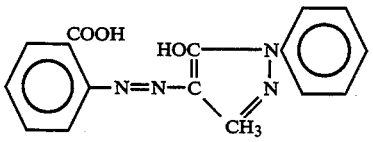

Anthranilic acid->3-methyl-1-phenyl-5-pyrazolone, (meaning the acid is first diazotized and then coupled with the pyrazolone).

Nevertheless, attempted use of Zapon Yellow 156 in toners formulated otherwise in accordance with this invention was not successful.

This invention employs a mixture of Solvent Yellow 81 dye and Solvent Orange 56 dye, sold as Zapon Yellow 141. The following two references are known only from database summaries in English. The first mentions Solvent Yellow 81 and the other mentions Solvent Orange 56 as dyes in toner, but not as general purpose charge control agents and not in combination: Japanese patent JP3094270-A issued Apr. 19, 1991, to Ricoh K. K. and Japanese patent J62024268-A issued Feb. 2, 1987, to Ricoh K. K.

DISCLOSURE OF THE INVENTION

A dry resin toner having Zapon Yellow 141 as a charge control agent, dispersed moderately in the toner. Zapon Yellow 141 is about 95% by weight Solvent Yellow 81 and about 5% by weight, Solvent Orange 56. Extreme mixing impairs the functioning this charge control agent. The preferred range of Zapon Yellow 141 is 0.25% to 0.75% by weight of total toner.

BEST MODE FOR CARRYING OUT THE INVENTION

Discussion of the Dye Mixture

Zapon Yellow 141 is a commercial product of BASF Corporation (Chemicals Division 100 Cherry Hill Road, Parsippany, N.J. 07054). According to the Material Safety Data Sheet (MSDS), its CAS No. is "proprietary". However, it does state on the MSDS:

Synonym

Mixture of Solvent Yellow 81, similar to C.I. 13900:1; and Solvent Orange 56, similar to C.I. 18745:1.

"C.I." is an abbreviation for Colour Index. The chemical family of Zapon Yellow 141 (also marketed under the trade name of Neozapon Yellow 141) is, "Azo Dye-Chromium Complex". The chemical formula and molecular weight are not applicable because the dye is a mixture.

The mix ratio is varied on a batch to batch basis to maintain color consistency. It is generally about 95% yellow. Solvent Orange 56 is available commercially through BASF as "Zapon Orange 245". The yellow component, Solvent Yellow 81, is not sold by BASF.

In the Colour Index 13900:1, "C.I. Solvent Yellow 19" is described as, free acid form of the chromium complex containing 1 atom of chromium to 1 mol monazo dye, derived from

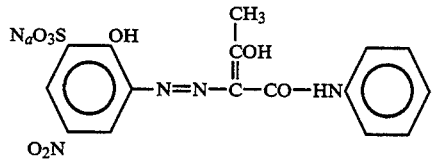

6-Amino-4-nitro-1-phenol-2-sulfonic acid->Acetoacetanilide, (meaning the acid is first diazotized and then coupled with the acetoacetarilide).

The reaction is with heat in a aqueous solution of chromium fluoride.

Similarly if one considers the Orange component (18745:1) in the Colour Index, one finds it described as, the free acid form of the chromium complex achieved by heating C.I. 18744 with chromium formate in aqueous solution at 130 C. for 3 hr.

C.I. 18744 (C.I. Mordant Orange 29) is of the following structure:

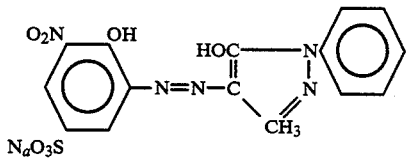

6-Amino-4-nitro-1-phenol-2-sulfonic acid->3-Methyl-1-phenyl-5-pyrazolone, (meaning the acid is first diazotized and then coupled with the pyrazolone).

The Toner Formulation

The toner is for use with a ferrite carrier (dual-component system) that is uncoated in the traditional sense. The toner formulation by weight is as follows:

1. Resin H-B71, styrene butyl acrylate copolymer, is manufactured by Sekisui America Corp., NEw York N.Y. The styrene content is 70%. The resin is a bi-modal system with the following molecular weights:

| | Wt. Av. MW | No. Avg. MW |
|---|---|---|
| Peak A | 14K | 5K |
| Peak B | 560K | 300K |

The polymer contains no gel. Content is 80 parts.

2. Resin CPR72-12A, crosslinked styrene/acrylic, is manufactured by Goodyear Tire and Rubber Co. of Akron, Ohio. The resin is 80% gelled. Content is 15 parts.
3. Raven 1020, carbon black pigment, is manufactured by Colombian Chemical Company of Tulsa, Okla. The toner content is 8 parts.
4. Viscol 550P, a linear polypropylene, is manufactured by Sanyo Chemical Industries and distributed by Inabata America Corp. of San Francisco, Calif. The toner content is 2 parts.
5. Zapon Yellow 141 content is 0.5 parts.

This mixture of ingredients is processed by generally conventional means: pulverize, dry blend, extrude, jet mill and classify by size except to minimize degradation of the Zapon Yellow 141, high temperature exposure is minimized by employing a double extrusion and adding the Zapon Yellow 141 on the second pass. Median particle size is 10 microns with less than 3% (by volume) greater than 16 microns and 1% maximum less than 5 microns. This toner is not conductive and is irregular in shape. The toner is then post-blended with 0.3% silica, Aerosil R-972, a product of Degussa Corporation, New Jersey, as a flow-enhancing agent.

The foregoing formula is essentially conventional and does not constitute a novel contribution of this invention except in the use of Zapon Yellow 141 and in the specific proportions employed.

High levels of Zapon Yellow 141 increase short term charging, since more charging sites are initially available, but transfer of the Zapon Yellow 141 to the carrier reduces the ability of the carrier to charge toner. Such transfer increases in proportion to the amount of change control agent in the toner. The preferred range of the Zapon Yellow 141 is 0.25% to 0.75% by weight of the toner. Loading up to 1.0% functions adequately. It may or may not be combined with other charge control agents. Function in other resin systems, such as polyester and styrene/butadiene, would be equivalent to that in the foregoing styrene/acrylic resin system.

In addition to the loadings indicated, some results suggest the dye should neither be mixed too well nor too poorly in order to optimize its function.

Additives for various functions in dry toner would not be expected to impair the charge control function of the Zapon Yellow 141.

We claim:

1. A dry toner comprising resin particles, coloring matter and a charge control agent comprising Zapon Yellow 141.

2. The toner as in claim 1 in which said Zapon Yellow 141 is in an amount of about 0.25 to 0.75 percent by weight of said toner.

3. The toner as in claim 2 in which the resin of said toner is predominately styrene/acrylic copolymer.

4. A dry toner comprising resin particles, coloring and a charge control agent comprising a mixture of major amount of Solvent Yellow 19 and a minor amount of Solvent Orange 56.

5. The toner as in claim 4 in which said mixture is in an amount of about 0.25 to 0.75 percent by weight of said toner.

6. The toner as in claim 5 in which the resin of said toner is predominately styrene/acrylic copolymer.

* * * * *